US005582160A

United States Patent [19]

Wu

[11] Patent Number: 5,582,160

[45] Date of Patent: Dec. 10, 1996

[54] GUARD DEVICE FOR SMOKE EXHAUSTER

[76] Inventor: Min-Wei Wu, 7F-2, No. 95-8 Chang Ping Road, Sec. 1, Taichung, Taiwan

[21] Appl. No.: 570,492

[22] Filed: Dec. 11, 1995

[51] Int. Cl.[6] ..... F02B 3/00

[52] U.S. Cl. ..... 126/299 C

[58] Field of Search ..... 126/299 R, 299 D, 126/299 C

[56] References Cited

U.S. PATENT DOCUMENTS 5,357,942 10/1994 Williams et al. ..... 126/299 C

*Primary Examiner*—Noah P. Kamen

[57] ABSTRACT

A guard device for protecting the front panel of a smoke exhauster is provided. The device comprises generally a rectangular guard plate slidingly held in a pair of securing appendages which are secured to the ends of the front panel and each has a slot, a fillet and a hook member. The guard plate is snap fitted and repeatedly slides about the slot in order to protect the front panel of the smoke exhauster from contamination with oil and grime.

1 Claim, 3 Drawing Sheets

GUARD DEVICE FOR SMOKE EXHAUSTER

BACKGROUND OF THE INVENTION

The present invention relates to smoke exhauster, and more particularly to a guard device which covers the front panel of a smoke exhauster for protecting the switch buttons of the panel from contamination with oil and grime.

Typically, smoke exhausters have an enclosure, a hood plate including a pair of apertures formed in the center for receiving the suction fans which are secured under the enclosure of the exhauster and a panel at the front portion of the enclosure on which a plurality of switch buttons which are arranged to switch on and off the suction fans to exhaust smoke out of a kitchen via a vent on the top of the exhauster.

Normally, the smoke exhauster is located over a stove or cooking range in a kitchen, and has a releasable structure so that both the fan housings and the hood plate are easily and quickly assembled or disassembled in order to facilitate frequent cleaning the accumulated oil and grime. However, the oil and grime on the front panel are difficult to remove because the switch buttons, especially the touch-to-run type, are sensitive to the detergent cleaners which etchs the surface of the button and infiltrates into the clearances therebetween that may mar the electronics in the panel. Thus, layers of oil and grime builds up on the panel as the time goes by and the switch buttons may become inactive if there is no corrective measure that has been taken to rectify this shortcoming.

SUMMARY OF THE PRESENT INVENTION

The present invention has a main object to provide a guard device for smoke exhauster which can effectively protect the panel of the smoke exhauster from contamination with oil and grime in order to keep the switch buttons on the panel to be active and reliable.

Another object of the present invention is to provide a guard device for smoke exhauster which has a simplified and adroit structure which is readily applied.

Accordingly, the guard device of the present invention comprises generally a guard plate and a pair of securing appendages which are symmetrically arranged and mounted to the lateral ends of the front panel of the exhauster and each has a longitudinal slide and transverse fillet therein for mounting the ends of the guard plate. The guard plate usually covers on the panel and is easily slid out when operating the switch button.

The present invention will become more fully understood by reference to the following detailed description thereof when read in conjunction with the attached drawings.

DETAILED DESCRIPTION OF THE PREFERRED EMBODIMENT

Figure 1:
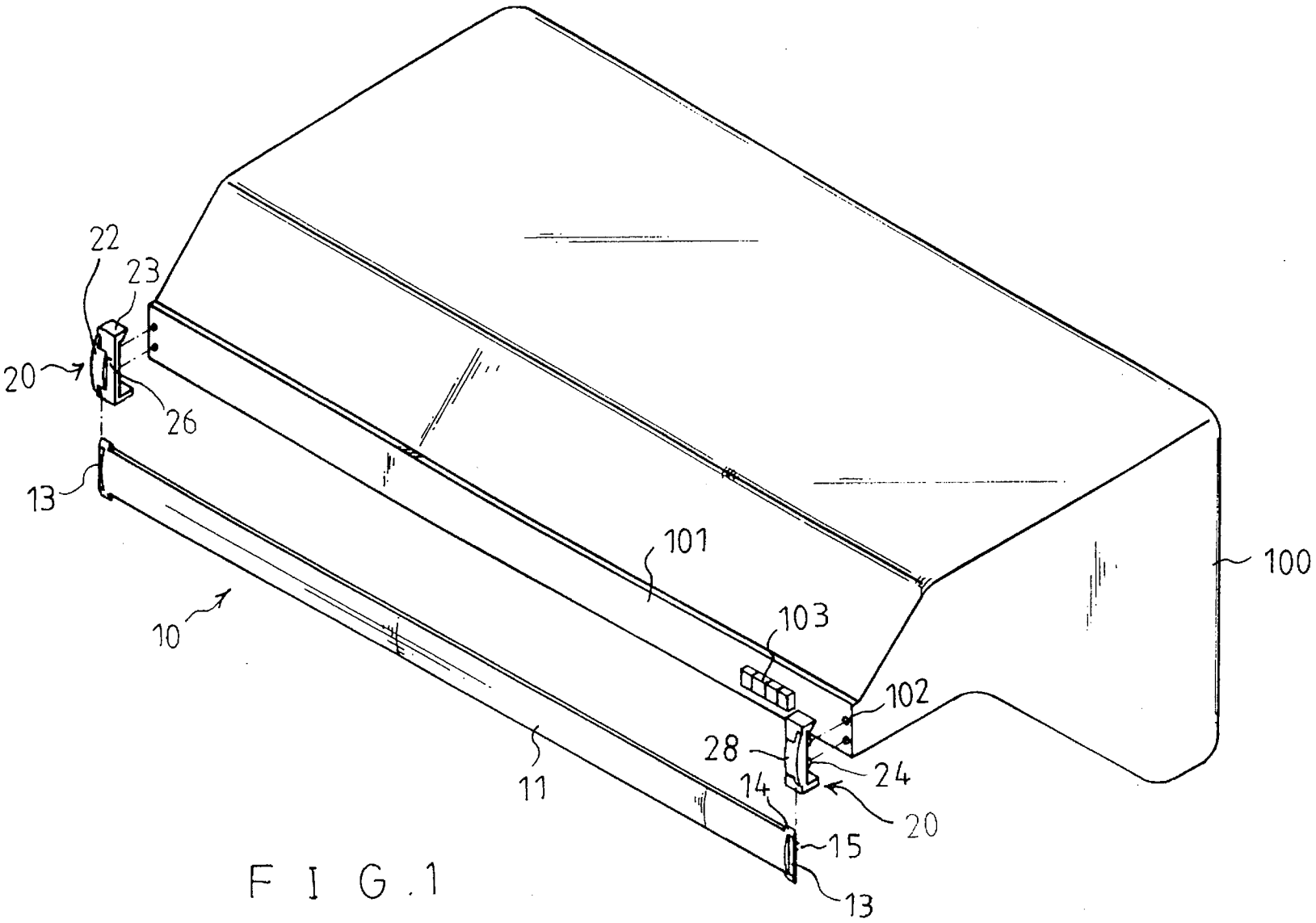
FIG. 1 is a perspective view to show the preferred embodiment of the guard device according to the present invention.
Figure 2:
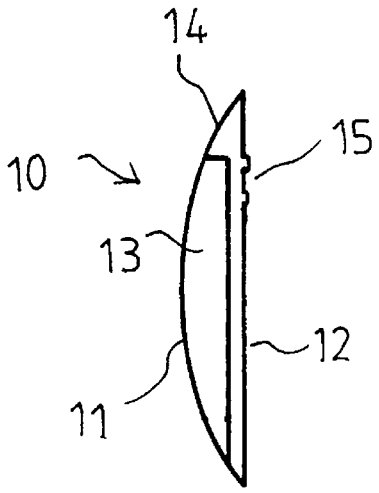
FIG. 2 is a sectional view of the guard plate.
Figure 3:
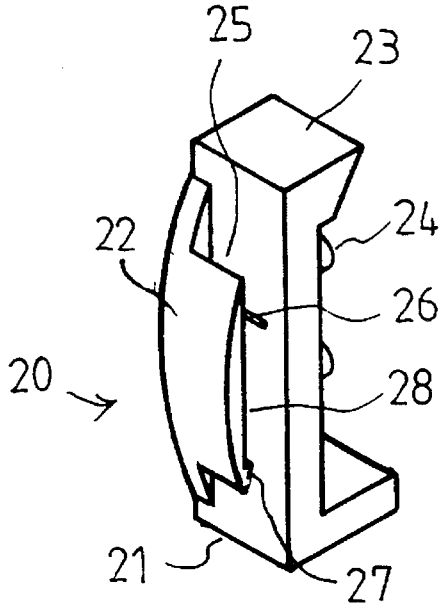
FIG. 3 is a perspective view of a enlarged securing appendage.

With reference to FIGS. 1, 2 and 3 of the drawings, the guard device of the present invention comprises a generally rectangular guard plate 10 and a pair of securing appendages 20. The guard plate 10 has an arched front surface 11, a planar rear surface 12 and a flat portion 13 at each end. Each flat portion 13 has a first hook member 14 at the upper end which has a roughly right angular section and an arched surface joined with the arched surface 11 of the plate 10 and a pair of parallel fillets 15 on the upper back side of portion 13.

Each securing appendage 20 has a rectangular body 21, a protruding portion 22 at front side, a pair of transverse flanges 23 rearwardly extending from two ends respectively, a pair of retaining rods 24 perpendicularly projecting from the inward surface of the rectangular body 21 and a transverse fillet 26 projecting from the outward surface which is formed in cooperation with the pair of fillets 15 of the guard plate 10. The protruding portion 22 is roughly T-shaped and abuts the most forward surface of the rectangular body 21 and defines a sliding space 25 therebetween and a second hook member 27 inwardly projecting from the lower edge of the transverse portion of the T-shaped.

The rectangular body 21 of the securing appendage 20 has a length equal to the width of the front panel 101 of the smoke exhauster 100, and the retaining rods are made in registry with holes 102 adjacent the lateral ends of the panel 101. So that the securing appendages 20 secure the two ends of the panel 101 (as shown in FIGS. 1 and 4).

The protruding portion 22 has a arched surface in configuration with the arched surface 11 of the guard plate 10 and the sliding spaces 25 of the two securing appendages 20 have their slots 28 facing inwardly so as to slideably receive two ends of the guard plate 10.

Figure 4:
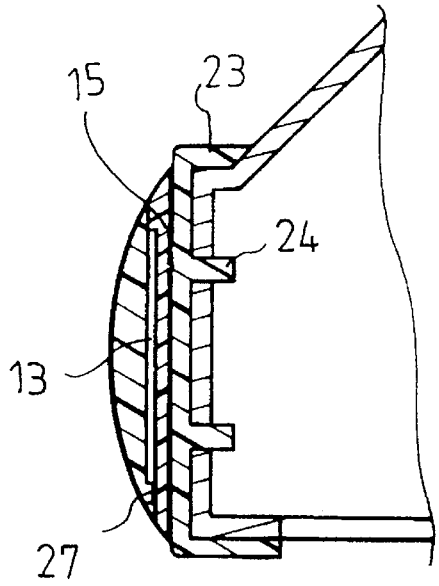
FIG. 4 is a sectional view illustrating the guard device of the present invention being mounted to the front panel of an exhauster.
Figure 5:
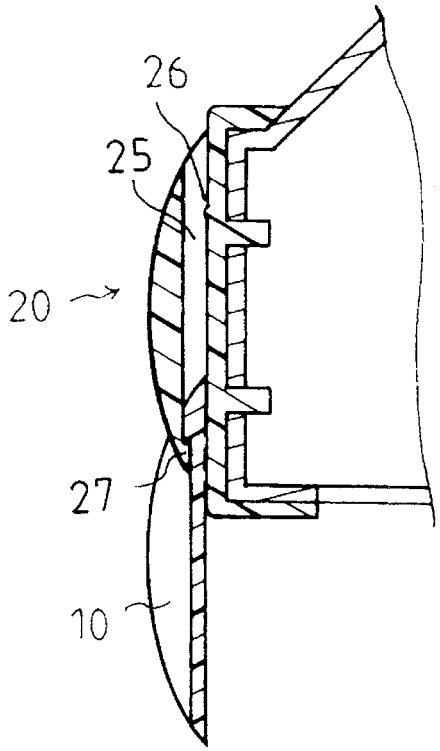
FIG. 5 is a sectional view indicating that the guard plate slides downward and is suspended by the securing appendage therefrom.

Referring to FIGS. 4 and 5, when the guard plate 10 slids in the pair of the securing appendages 20, the fillets 15 will engage the fillets 26 of the securing appendages 20 in snap fitting so that the plate 10 is held in the appendages and completely covers the front panel 101. When the smoke exhauster control buttons 103 are to be used, pressing the guard plate 10 downwardly reveals the buttons 103. The plate is suspended by the second hook member 27 which has an upper surface mating with the lower surface of the first hook member 14 of the plate 10. After operating the switch buttons 103, the plate 10 is moved upward so as to snap fit again the plate 10 in place into the sliding space 25. Repeated operation of the guard plate 10 as recited above would be necessary and easy to do.

Note, the specification relating to the above embodiment should be construed as exemplary rather than as limitative of the present invention, with many variations and modifications being readily attainable by a person of average skill in the art without departing from the spirit or scope thereof as defined by the appended claims.

I claim:

1. A guard device for protecting the control buttons on the front panel of a smoke exhauster comprising:

a guard plate comprising a rectangular body with an arched front surface, a planar rear surface with at least one filler, and hook means at either end;

a pair of securing appendages located at each end of said front panel, said appendages comprising inwardly facing slots, hook means on one side within said slots, and on the other side of said slots;

wherein said guard plate is slidably pressed down in said slots until said hooks engage one another, thereby revealing said control buttons for operation, after which the guard plate is pushed up until said fillets engage each other, the guard plate is then positioned to cover said buttons so as to prevent grease build up on said buttons.

* * * * *